US011745199B2

(12) United States Patent
Pawluszek et al.

(10) Patent No.: US 11,745,199 B2
(45) Date of Patent: Sep. 5, 2023

(54) DISPENSING DEVICE

(71) Applicant: Anna Pawluszek, Gliwice (PL)

(72) Inventors: Anna Pawluszek, Gliwice (PL); Michal Wujczak, Wieliczka (PL); Artur Mlynski, Cracow (PL); Artur Terlecki, Strzyzow (PL); Przemyslaw Dobinski, Myslowice (PL); Mateusz Luczynski, Nawojowa Gora (PL)

(73) Assignee: Anna Pawluszek, Gliwice (PL)

( * ) Notice: Subject to any disclaimer, the term of this patent is extended or adjusted under 35 U.S.C. 154(b) by 27 days.

(21) Appl. No.: 17/610,244

(22) PCT Filed: May 8, 2020

(86) PCT No.: PCT/EP2020/062845
§ 371 (c)(1),
(2) Date: Nov. 10, 2021

(87) PCT Pub. No.: WO2020/229340
PCT Pub. Date: Nov. 19, 2020

(65) Prior Publication Data

US 2022/0241808 A1 Aug. 4, 2022

(30) Foreign Application Priority Data

May 10, 2019 (PL) ..... 429898

(51) Int. Cl.
*B05B 11/00* (2023.01)
*B05B 11/02* (2023.01)
*B05B 11/10* (2023.01)

(52) U.S. Cl.
CPC ..... *B05B 11/026* (2023.01); *B05B 11/1074* (2023.01); *B05B 11/0056* (2013.01); *B05B 11/1069* (2023.01)

(58) Field of Classification Search
CPC . B05B 11/026; B05B 11/0056; B05B 11/104; B05B 11/1069; B05B 11/1074
See application file for complete search history.

(56) References Cited

U.S. PATENT DOCUMENTS 2,815,890 A * 12/1957 Cooprider ..... E01H 5/096 222/207
4,846,372 A * 7/1989 von Schuckmann ..... B65D 83/0033 222/492
5,664,703 A * 9/1997 Reifenberger ..... B05B 11/1067 222/207

(Continued)

*Primary Examiner* — Vishal Pancholi
(74) *Attorney, Agent, or Firm* — Andrew D. Dorisio; Dickinson Wright PLLC

(57) ABSTRACT

A dispensing device (100) according to the invention comprises a reservoir (4) for a liquid or semi-liquid substance to be dispensed and a pumping mechanism (5) for dispensing the substance. The device is characterized in that it includes a housing (1), in which an upper body (2) and a lower body (3) are located, wherein a deformable reservoir (4) is located on or around the lower body (3) and the pumping mechanism (5) is located in the upper body (2). A supply valve (6) and a dispensing valve (8) are located in the lower body (3), and the supply valve (6) is connected by means of a lower channel (7) with the reservoir (4), and a dispensing valve (8) is connected by means of an upper channel (9) with the pumping mechanism (5).

6 Claims, 4 Drawing Sheets

(56) References Cited

U.S. PATENT DOCUMENTS

Figure 1:
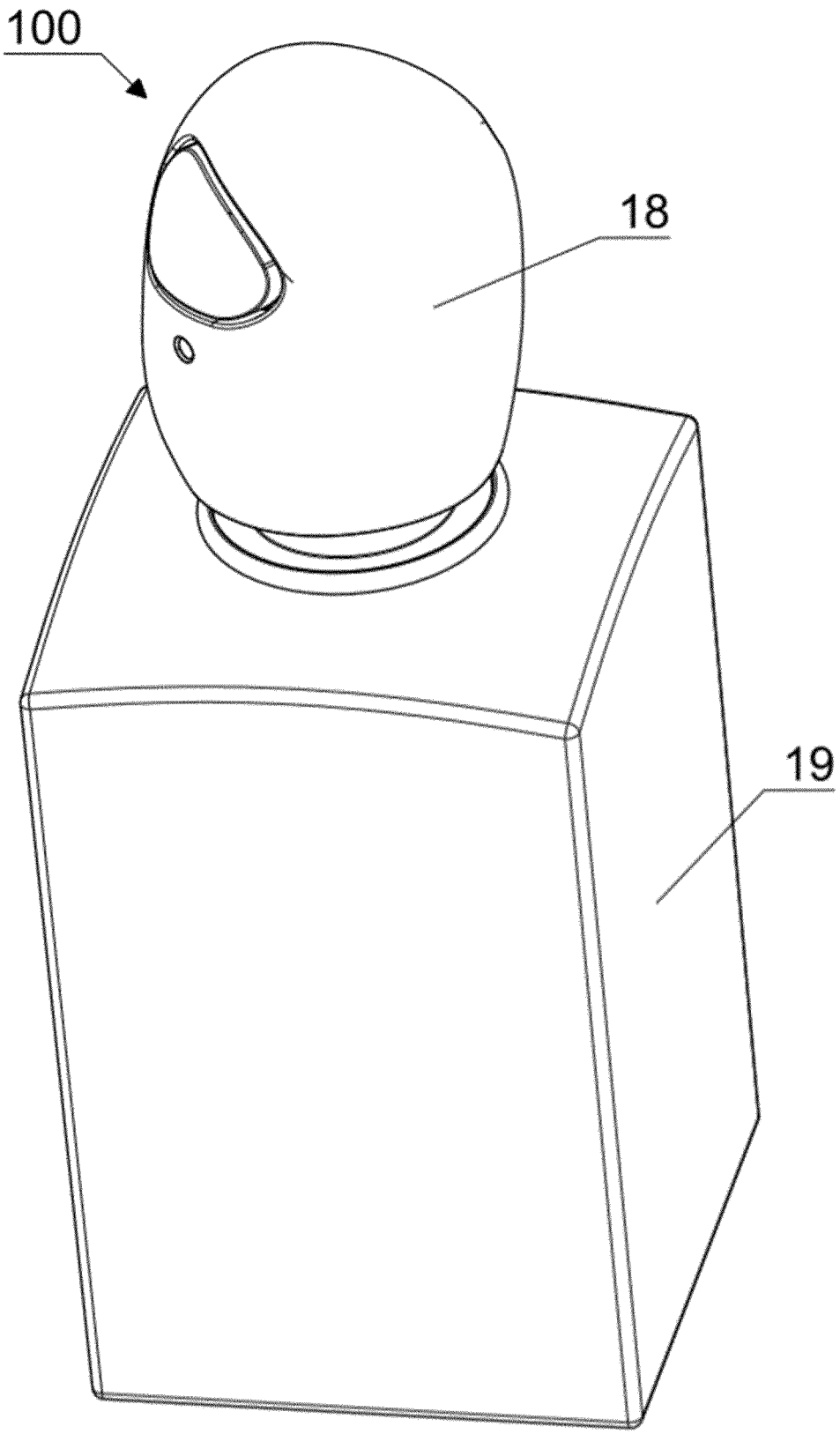

| | | | | |
|---|---|---|---|---|
| 9,718,072 | B2 * | 8/2017 | Bruder | B05B 11/00442 |
| 10,807,113 | B2 * | 10/2020 | Santagiuliana | B05B 11/1067 |
| 2013/0269830 | A1 * | 10/2013 | Farrar | A45D 34/02 141/27 |
| 2016/0167075 | A1 * | 6/2016 | Mizushima | B05B 7/0037 222/189.11 |

* cited by examiner

DISPENSING DEVICE

The subject of the invention is a dispensing device for dispensing liquid and semi-liquid substances, for example cosmetics, including perfumes, lotions, creams, emulsions and also medicinal substances, wherein the dispensing device can be refilled many times.

Various types of containers are known for storing and dispensing particularly liquid but also semi-liquid substances at an appropriate moment. They comprise, for example, a bottle equipped with a pump. The task of the pump is to create pressure in the container by manually pressing a button, located outside of the container and being connected to the pump. Created pressure causes the substance in the container, such as perfume, to escape through an atomizer to the outside of the container. The atomizer is a device that atomizes a dosed substance in a form of a mist.

A dispenser with a container for an agent to be applied and with a pump for dosing and dispensing of the agent contained in the container, as well as with a pressure-equalizing unit, assigned to the container, characterized in that at least one pressure equalizing hole, which is open to the atmosphere, is assigned to the container for the applied agent, which has a shape of a nozzle, narrowing towards the atmosphere and having a minimum diameter of 0.1 mm to 0.3 mm is known from a polish patent specification no. PL201051B1.

Such containers are used at home practically up to several times a day and are stored e.g. in a home cabinet or on a shelf in the bathroom. Due to the frequency of use and ease of storage, such containers have a relatively large volume in order to minimize a need of purchasing substance with the container.

However, such containers become inconvenient if the user of the substance, such as perfumes, needs to travel for a short period of time and wants to take the container along. It turns out that in the event of such a trip, the amount of needed substance is many times smaller than the content of known containers.

Of course, it is possible to make very small containers, but this is uneconomical for the user.

Therefore, the best solution would be a small container that one can refill himself from a large container, when its content is used.

Document WO-A-2005/101969 discloses a perfume bottle, refillable from a conventional perfume bottle, which is equipped with a spray system. A spray cap is removed from the perfume bottle and a spray rod is introduced into the bottle to be filled. Perfumes are dispensed from the large bottle into the small refillable bottle by successive vertical pushes to create pressure.

A loading device for loading a refillable bottle is known from a french application no FR2904613A1. It is particularly used for reloading of liquids such as perfumes. The device comprises a container for storing liquids e.g. fragrance agents, loading means located in an upper part of said device, capable of cooperating with refillable bottle filling means and intended for passing fluid from said container into a refillable bottle. The device is characterized in that it comprises guide means, arranged in the upper part of said device and adapted to cooperate with positioning means of said refillable bottle.

A device for dispensing a dose of a given volume of a liquid or pasty product is known from U.S. Pat. No. 5,524,680A. The device comprises a receptacle, capable of containing several doses of the product, a bottle capable of containing a single dose of the product, means for transferring the product from the receptacle into the bottle, and a means for dispensing the dose of product from the bottle, said bottle being adapted to be fixed removably to the receptacle and to slide longitudinally with respect to said receptacle. The device is characterized in that the receptacle is equipped with a first pump, including a hollow control rod for transferring, by forcing, the product from the receptacle into the bottle. The bottle is equipped at one end with a second pump and with a dispensing head for dispensing the dose of product from the bottle, said bottle having, at the other end, a bottom designed to interact with an end of the control rod of the first pump and including a valve sealing off a passage for communication between the receptacle and the bottle formed in said bottom, and opening only under the pressure of the product contained in the receptacle, when the first pump is actuated.

Although the solutions known from the art fulfill their roles, they have drawbacks, which particularly include a need to disassemble elements of a loading container before connecting to it a to-be-loaded container.

Another disadvantage of the known solutions is a need of having two containers and optionally a lid for the loading container, if it is used to dispense a substance contained.

The invention aims to overcome the disadvantages of the state-of-the-art solutions and to develop a dispensing device for dispensing liquid and semi-liquid substances, which can be refilled many times.

A dispensing device according to the invention comprises a reservoir for the liquid or semi-liquid substance to be dispensed and a pumping mechanism for dispensing the substance. The device comprises a housing, in which an upper body and a lower body are located, wherein a deformable reservoir is located on or around the lower body and the pumping mechanism is located in the upper body, and wherein a supply valve and a dispensing valve are located in the lower body, the supply valve being connected by means of a lower channel with the deformable reservoir and the dispensing valve being connected by means of an upper channel with the pumping mechanism.

Preferably, the deformable reservoir is a deformable ring-shaped diaphragm, enclosing the lower body and being attached to it by elastic rings on both of its edges, so that the lower channel, which is connected to the supply valve, extends from the lower body onto an inner surface of the reservoir, between the elastic rings.

Preferably, the supply valve is a ball valve, closeable by a compression spring.

Preferably, the dispensing valve is ball valve, closeable by an upper spring.

It is advantageous, when the pumping mechanism is a button, supported by a return spring, the button being connected to a piston, located in a first chamber, said first chamber being provided in the upper body, the first chamber being connected by the upper channel with the dispensing valve, and wherein in the upper body, behind the first chamber there is provided a second chamber, connected to an atomizer, and wherein between the first chamber and the second chamber a membrane plug is located, the membrane plug being supported by an additional spring, wherein the membrane plug is for controlling of the flow of a substance to channels connecting the second chamber with the atomizer.

Preferably, the housing of the dispensing device forms a cover for an external supply container.

Figure 2:
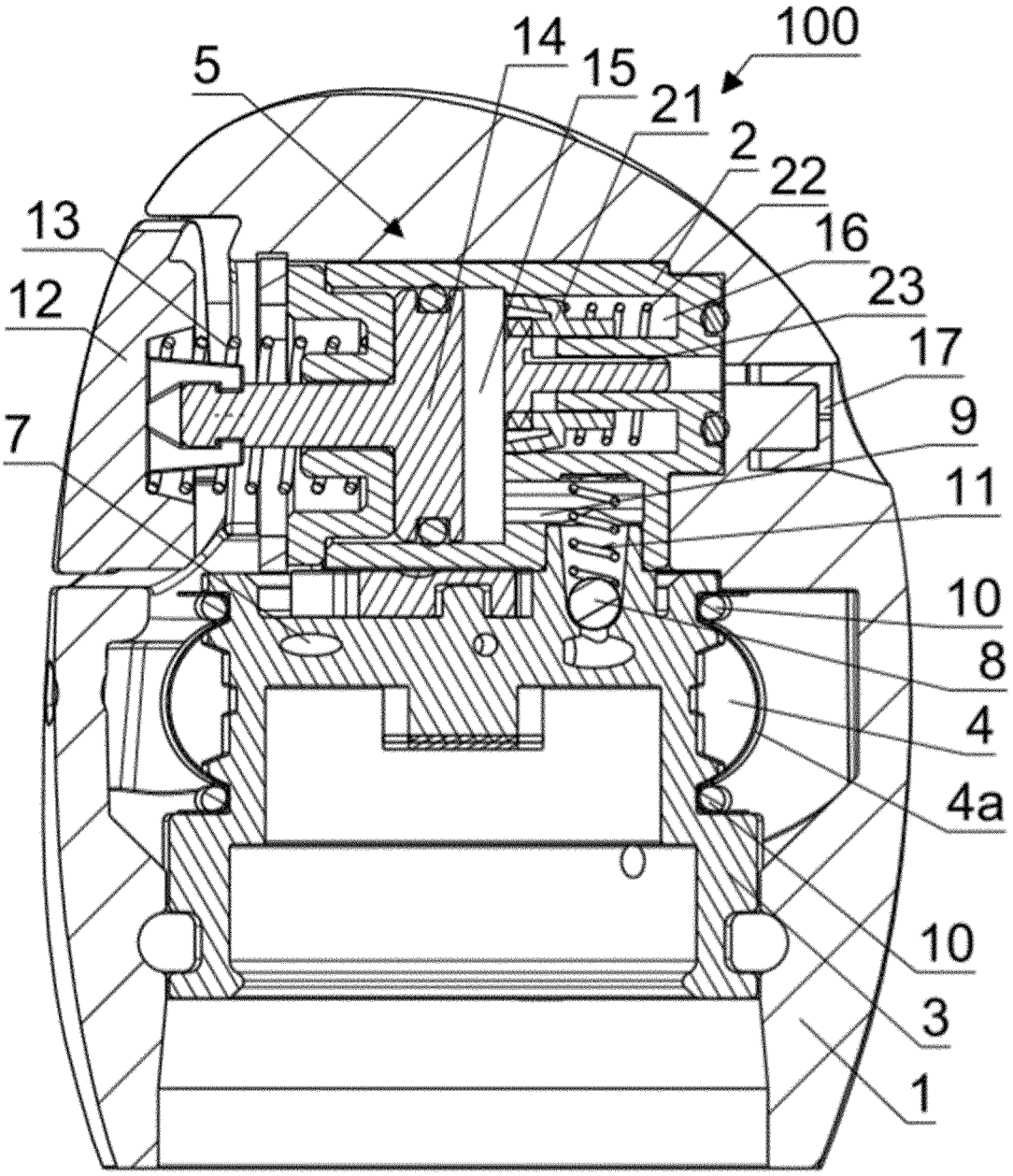
Figure 3:
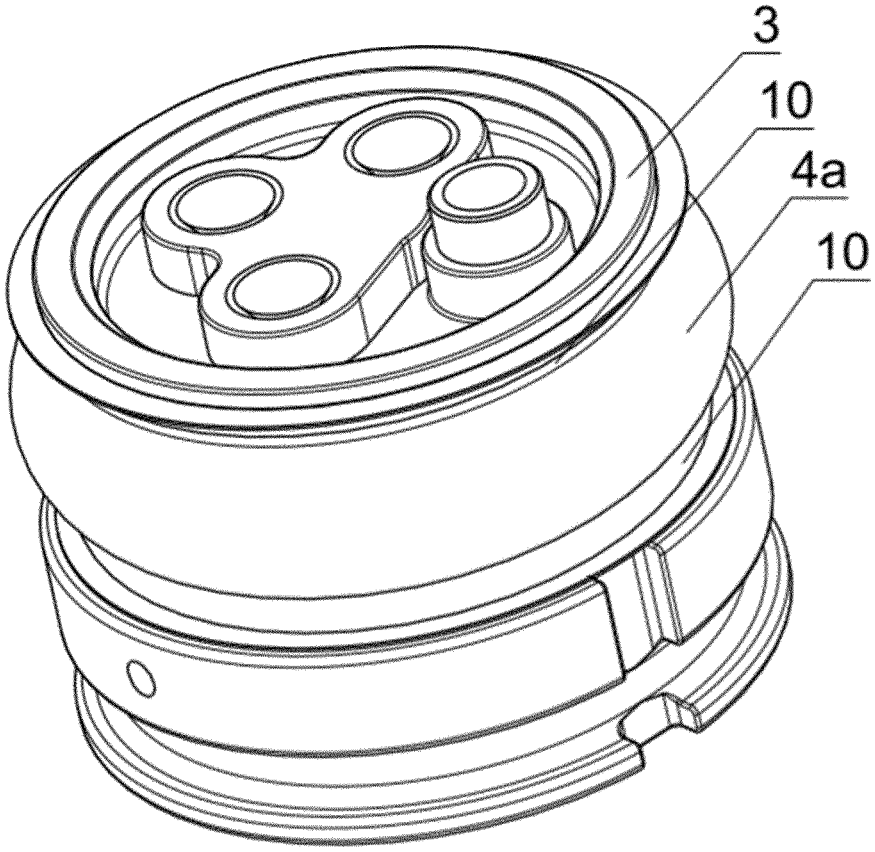
Figure 4:
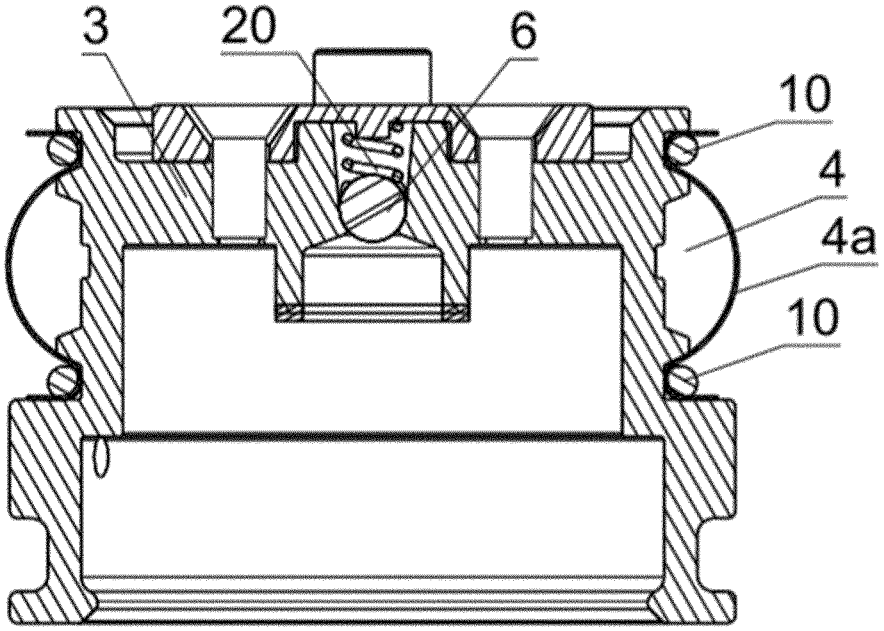
Figure 5:
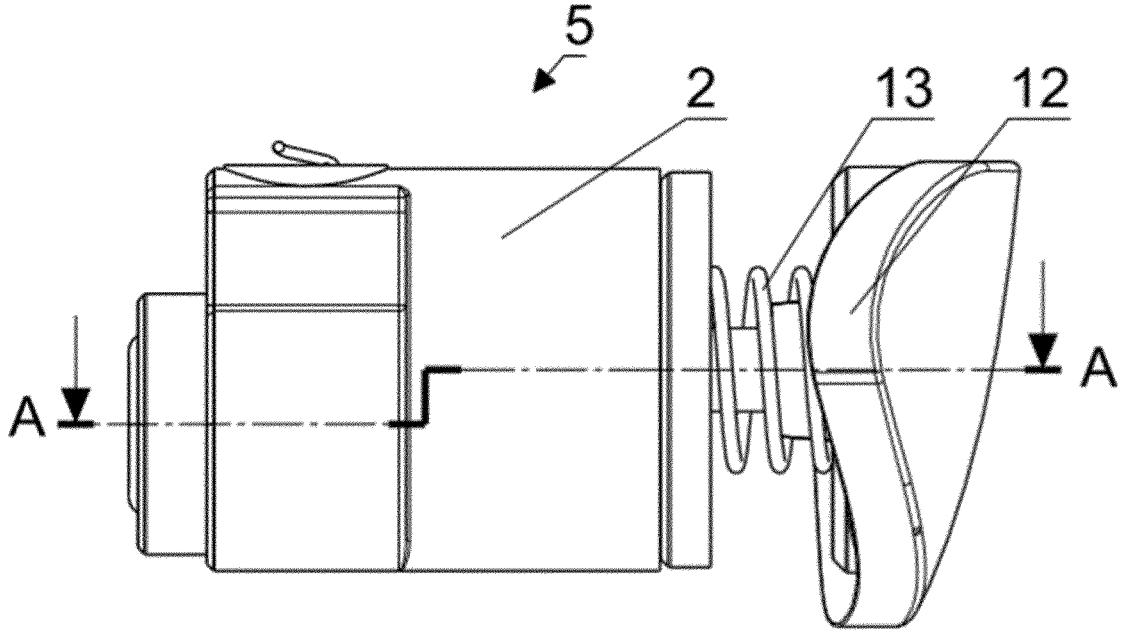
Figure 6:
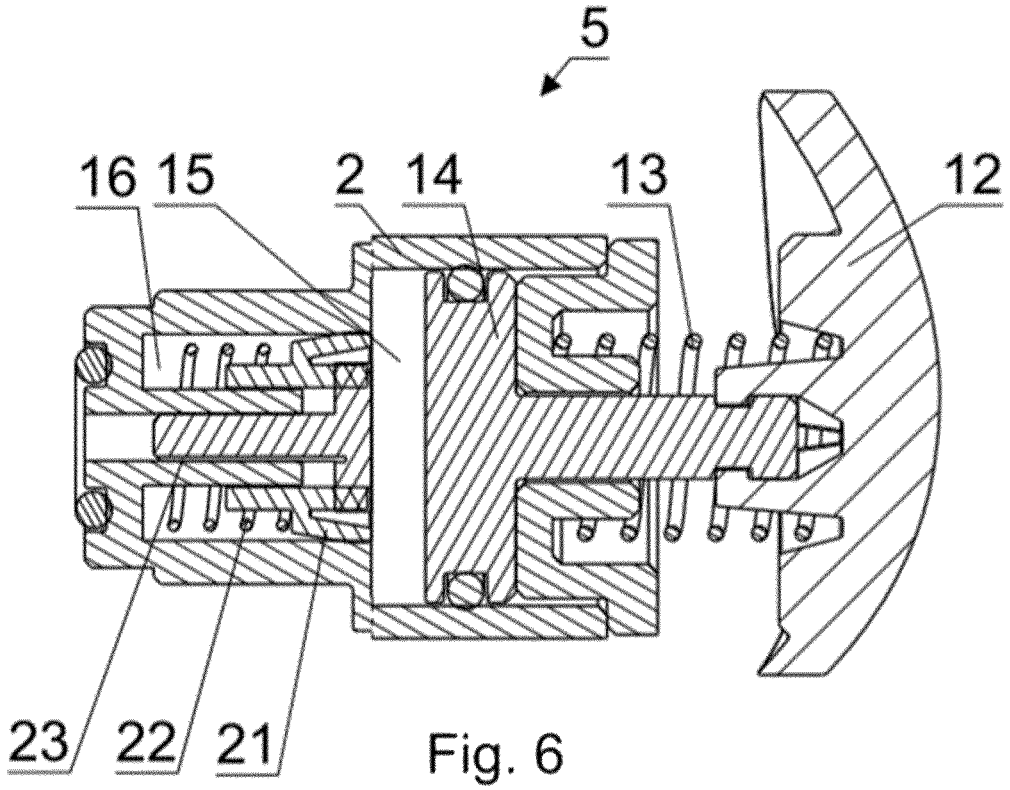

The subject of the invention is shown in an embodiment in the figures, in which FIG. 1 presents a dispensing device as the cover of an external supply container in a side perspective view, FIG. 2 presents a longitudinal section of the dispensing device, FIG. 3 presents a lower body of the dispensing device in a side perspective view, FIG. 4 presents the lower body of the dispensing device in a section along a vertical axis, FIG. 5 presents a side view of an upper body of the dispensing device and FIG. 6 shows a cross-section of the upper body of the dispensing device along the line AA from FIG. 5.

As shown in the embodiment in FIG. 1, a dispensing device 100 for dispensing liquids and semi-liquids e.g. cosmetics including perfumes, lotions, creams, emulsions and also medicinal substances, can be a cover 18 of a larger supply container 19, that can form a source of a liquid or semi-liquid substance e.g. perfumes for the dispensing device 100, when the dispensing device 100 is emptied. As shown in FIGS. 1 and 2, the dispensing device 100 is an irregularly shaped spatial body, but it is obvious that it can have a shape of a regular solid, for example a cylinder, a cube or any other cuboid. The cover 18 may have a shape and dimensions known from common perfume bottle covers.

The dispensing device 100 is suitable to put therein a smaller amount of substance, e.g. several single doses, said dispensing device 100 being equipped with its own pumping mechanism 5, allowing use of the dispensing device 100 to dispense the liquid or semi-liquid substance it contains, such as perfume or cologne.

As shown in FIG. 2, in the embodiment, the dispensing device 100 comprises a housing 1, in which an upper body 2 and a lower body 3 are located. A deformable reservoir 4 is located around the lower body 3 and a pumping mechanism 5 is located in the upper body 2. The lower body 3 is also shown in FIG. 3 in a perspective view and in FIG. 4 in an axial section. The upper body 2 is also shown in FIG. 5 in a side perspective view and in FIG. 6 in a section according to the line A-A from FIG. 5.

The reservoir 4 of the dispensing device 100 is a deformable diaphragm 4*a* of a ring shape, enclosing the lower body 3 and being attached to it by elastic rings 10 on both of its edges, as shown in FIG. 2, FIG. 3 and FIG. 4. Obviously, in other embodiments the reservoir 4 can have a different shape, such as a shape of a deformable bag, attached to the lower body 3 on one side by the elastic ring 10 and on the other side sealed to an upper surface of the lower body 3 by pressing it with internal elements of the housing 1.

As shown in FIG. 2 and FIG. 4, a supply valve 6 is located in the lower body 3, depicted in FIG. 4, wherein the supply valve 6 is connected by means of a lower channel 7, shown in FIG. 2, to the reservoir 4, and wherein a dispensing valve 8, visible in FIG. 2, is connected by an upper channel 8 and a side channel 9 with the pumping mechanism 5. In this embodiment, the supply valve 6 is a ball valve, closeable by a compression spring 20. In addition, the compression spring 20 is supported by pressure inside the reservoir 4. It is also possible that the supply valve 6 will only be closed by pressure inside the reservoir 4. In this embodiment the dispensing valve 8 is a ball valve, closeable by an upper spring 11. It is obvious that in a rest state a force of the upper spring 11 of the dispensing valve 8 is greater than a force resulting from the pressure in the reservoir 4, so that the dispensing valve 8 remains closed despite an increase in pressure in the reservoir 4, resulting form pumping liquid into it and stretching the wall of the diaphragm 4*a* of the reservoir 4.

The lower channel 7, connected to the supply valve 6, exits the lower body 3 into the inner surface of the reservoir 4, between the elastic rings 10.

After filling the reservoir 4 and disconnecting the dispensing device 100 from a source of substance, the dispensing device 100 can be used to dispense the substance contained therein, which in the embodiment is perfume. The dispensing device 100 is a container of a travel type and contains a much smaller amount of substance than can be contained in a typical home perfume container, for example a bottle.

In order to allow for dispensing of a substance, such as perfume, from the dispensing device 100, it is provided with the pumping mechanism 5, as shown in the embodiment in FIG. 2, FIG. 5 and FIG. 6. The pumping mechanism 5 is a button 12, supported by a return spring 13, wherein the button 12 is connected to a piston 14, the piston 14 being located in a first chamber 15, said first chamber being provided in the upper body 2 of the dispensing device 100. The first chamber 15 of the dispensing device 100 is connected by the upper channel 9 to the dispensing valve 8 in the upper body 2.

In the upper body 2, behind the first chamber 15, there is a second chamber 16 located, connected to an atomizer 17. Between the first chamber 15 and the second chamber 16 a membrane plug 21 is located, the membrane plug 21 being supported by an additional spring 22, wherein the membrane plug 21 is for controlling of a flow of the substance to channels 23, connecting the second chamber 16 to the atomizer 17.

When the user of the dispensing device 100 presses the button 12, the piston 14 compresses the substance contained in the first chamber 15, between the piston 14 and the second chamber 16. The dispensing valve 8 prevents the substance from entering the reservoir 4. The pressure in the first chamber 15, caused by the pressure exerted on the button 12 causes the membrane plug 21, pushed towards the first chamber 15 through the additional spring 22, to be pushed towards the outlet of the atomizer 17. This movement of the membrane plug 21 exposes the channels 23, connecting the first chamber 15 to the atomizer 17, and results in dispensing the liquid substance, in this embodiment—a perfume, in a form of an aerosol mist.

Releasing the pressure on the button 12 activates the return spring 13, which pulls the piston 14 in the first chamber 15 towards the button 12. This action, in a first aspect, releases the membrane plug 21, which, moving under the action of the additional spring 22 towards the first chamber 15, closes the channels 23 and, in a second aspect, under the influence of the vacuum created, it opens the dispensing valve 8. The substance, which in this embodiment is perfume, passes from the reservoir 4 through the dispensing valve 8 into the first chamber 15 and the dispensing device 100 is ready to dispense another portion of substance. This can be done by pressing the button 12 again. Of course, this will only be possible until the reservoir 4 of the dispensing device 100 is completely empty.

To refill the reservoir 4, the dispensing device 100 must be connected to a source of substance to be dispensed. Such a source may be, for example, a larger container with a liquid or semi-fluid substance, for example perfumes. To this end, the dispensing device 100 and the larger container can be suitably adapted to a dedicated filling of the dispensing device 100 by ensuring their interconnection and coupling of a path of the liquid substance.

It is also possible to fill the dispensing device 100 from any container, equipped with a pressure pump or containing a liquid or semi-fluid substance under pressure by removing a typical spray tip from the container, for example with perfumes, and pressing the pump tip of that container onto the supply valve 6 of the dispensing device 100.

LIST OF REFERENCE NUMERALS, PRESENTED ON THE FIGURES

1—housing
2—upper body
3—lower body
4—reservoir, 4*a*—diaphragm
5—pumping mechanism
6—supply valve
7—lower channel
8—dispensing valve
9—upper channel
10—elastic ring
11—upper spring
12—button
13—return spring
14—piston
15—first chamber
16—second chamber
17—atomizer
18—cover
19—supply container
20—compression spring
21—membrane plug
22—additional spring
23—channels
100—dispensing device

The invention claimed is:

1. A dispensing device comprising a housing (1), an upper body (2) and a lower body (3) located in the housing (1);

a deformable reservoir (4) for storing a liquid or semi-liquid substance to be dispensed, a pumping mechanism (5) for dispensing the substance located in the upper body (2), characterized in that said deformable reservoir (4) is located on or around the lower body (3), a supply valve (6) and a dispensing valve (8) are located in the lower body (3), wherein the supply valve (6) is connected by a lower channel (7) located in the lower body (3) with the deformable reservoir (4), and wherein the dispensing valve (8) connects the deformable reservoir (4) by an upper channel (9) located in the upper body (2) with the pumping mechanism (5).

2. The dispensing device according to claim 1, characterized in that the deformable reservoir (4) is a ring-shaped deformable diaphragm (4*a*), enclosing the lower body (3) and being attached to it by elastic rings (10) on both edges, so that the lower channel (7) connected to the supply valve (6) exits from the lower body (3) onto an inner surface of the deformable reservoir (4) between the elastic rings (10).

3. The dispensing device according to claim 1, characterized in that the supply valve (6) is a ball valve, which is closeable by a compression spring (20).

4. The dispensing device according to claim 1, characterized in that the dispensing valve (8) is a ball valve, which is closeable by an upper spring (11).

5. The dispensing device according to claim 1, characterized in that the pumping mechanism (5) is a button (12), supported by a return spring (13), wherein the button (12) is connected to a piston (14), said piston (14) being located in a first chamber (15) in the upper body (2), wherein the first chamber (15) is connected by means of the upper channel (9) with the dispensing valve (8) and wherein in the upper body (2) there is a second chamber (16) located behind the first chamber (15), the second chamber (16) being connected to the atomizer (17), and wherein between the first chamber (15) and the second chamber (16) a membrane plug (21) is located, the membrane plug (21) being supported by an additional spring (22), wherein the membrane plug (21) is for controlling of the flow of a substance to channels (23) connecting the second chamber (16) with the atomizer (17).

6. The dispensing device according to claim 1, characterized in that the housing (1) of the dispensing device (100) forms a cover (18) of an external supply container (19).

* * * * *